United States Patent [19]

Lilienthal

[11] Patent Number: 4,593,836

[45] Date of Patent: Jun. 10, 1986

[54] DOUBLE CHAMBER AEROSOL CONTAINER

[75] Inventor: Johannes H. Lilienthal, Wulfsdal, Fed. Rep. of Germany

[73] Assignee: Societe Avitex, Saint Maur, France

[21] Appl. No.: 608,727

[22] Filed: May 10, 1984

[30] Foreign Application Priority Data

May 13, 1983 [FR] France ..... 83 07989

[51] Int. Cl.[4] ..... B65D 83/14

[52] U.S. Cl. ..... 222/136; 222/135; 222/399; 222/402.14

[58] Field of Search ..... 222/129, 135, 136, 145, 222/190, 394, 399, 402.1, 402.14, 402.24; 169/85, 88, 78, 30; 239/304, 309; 141/17, 19, 20; 206/219, 221; 215/DIG. 8

[56] References Cited

U.S. PATENT DOCUMENTS

| | | | |
|---|---|---|---|
| 2,630,942 | 3/1953 | Shaffer | 239/309 X |
| 2,845,203 | 7/1958 | Potash | 222/402.24 |
| 3,255,926 | 6/1966 | Modderno | 222/145 X |
| 3,630,415 | 12/1971 | Morane | 141/20 X |
| 3,804,302 | 4/1974 | Yamada et al. | 222/402.14 |
| 3,865,158 | 2/1975 | Withrow | 141/19 |
| 4,427,039 | 1/1984 | Brooks et al. | 141/20 |
| 4,469,252 | 9/1984 | Obrist | 222/399 X |

FOREIGN PATENT DOCUMENTS

| | | | |
|---|---|---|---|
| 531729 | 10/1956 | Canada | 222/394 |

*Primary Examiner*—Joseph J. Rolla
*Assistant Examiner*—Kevin P. Shaver
*Attorney, Agent, or Firm*—Frost & Jacobs

[57] ABSTRACT

A double-chamber aerosol container is constructed using two conventional aerosol receptacles each having a valve at one end. A first of the receptacles is an outer receptacle which contains one of the components of the product to be dispensed. The other of the receptacles is smaller and is contained within the outer receptacle with its valve facing the bottom of the outer receptacle. The inner receptacle contains a propellent gas and a second component of the product to be dispensed. The outer container has an inwardly displaceable closing plug in its bottom which, when displaced inwardly opens the valve in the inner receptacle to discharge the contents of the inner receptacle into the outer receptacle. A sealing gasket surrounding the closing plug permits it to be displaced inwardly while maintaining the sealed condition of the container.

4 Claims, 1 Drawing Figure

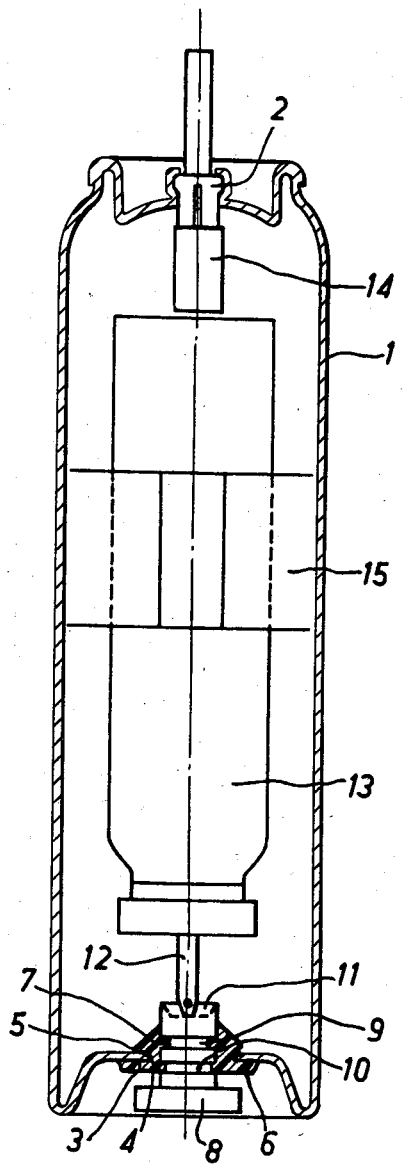
2
14
1
15
13
12
11
7
9
5
10
3
4
8
6

DOUBLE CHAMBER AEROSOL CONTAINER

BACKGROUND OF THE INVENTION

The present invention relates to a double-chamber aerosol container. Such a container consists of two conventional commercial aerosol receptacles. One of these receptacles, called the outer receptacle, is provided in its upper part with a dispensing valve of conventional type, the said outer receptacle serving as a container for one component of the product to be dispensed and for a second aerosol receptacle of conventional type, called the inner receptacle, the said inner receptacle being equipped with a transfer valve of conventional type and serving as a container for a propellent gas and for another component of the product to be canned.

The outer receptacle is provided at its bottom with a system called a shutter, designed in such a way that a pressure exerted from outside on the said shutter opens the valve of the inner receptacle and thus allows the content of the inner receptacle to pour into the outer receptacle and mix with the content of the outer receptacle.

Double-chamber containers have a very wide field of use. It is appropriate to employ them in all cases where, for various reasons, a product takes the form of two components which are to be brought in contact and mixed with one another only at the moment when they are used, such as, for example, hair-dyeing products, two-component adhesives, two-component foams, quick-drying and impact-resistant varnish paints and other products of the same type.

PRIOR ART

Various double-chamber systems are known at the present time, such as, for example, the system in document DE-A No. 2,916,999, where the various components are mixed via a dispensing and mixing valve system which is complicated to produce. According to another invention described in document DE-A No. 3,116,282, two aerosol containers are mounted on one another and connected by a system of transfer valves. Here, mixing takes place in the upper container after the two containers have been brought near to one another. The disadvantages of this invention is that the upper container must incorporate another valve called a dispensing valve; the total number of valves therefore increases to three here. Furthermore, an outer sleeve is necessary to position the two containers correctly thus making this system complicated and costly.

The object of the present invention is to provide a double-chamber system, for products with several components which are to be mixed only at the moment of use, the system being simple and therefore inexpensive to construct and use, while at the same time safeguarding against inadvertent manipulation causing the various components to be mixed at an undesirable moment.

SUMMARY OF THE INVENTION

The present invention provides a double-chamber aerosol container for the packaging of products with several components which are to come in contact and be mixed with one another only at the moment of use. The container comprises a first aerosol receptacle of conventional type, serving as an outer receptacle and provided with a dispensing valve of conventional type. The first receptacle contains one of the components of the final product and a second aerosol receptacle of conventional type, serving as a container for the propellent gas and for another component of the final product, the second receptacle being provided with a stem valve of conventional type. In accordance with the invention, the inner receptacle is positioned and centered upside down in the outer receptacle and rests by means of the stem of its valve on the upper part of a closing plug which is force-fitted into an orifice in the bottom of the outer receptacle. The closing plug is displaceable inwardly so that its upper part exerts pressure on the stem of the valve of the inner receptacle, the bottom of the inner receptacle being seated against a strut located in the outer receptacle, with the result that the pressure exerted on the closing plug causes the valve of the inner receptacle to open and thus brings about the mixing of the various components.

The present invention combines the various advantages mentioned above, in that two conventional aerosol receptacles may be used, each receptacle being equipped with only a single valve of conventional type. The inner receptacle is of smaller size than the outer receptacle and is equipped with a conventional valve of the male-valve type, the valve and its stem being located on the same side as the bottom of the abovementioned outer receptacle, the outer receptacle being equipped in its upper end with a dispensing valve of conventional type.

The inner receptacle serves as a container for the propellent gas and for one of the components of the product, and the said component is to be mixed with the other component contained in the outer receptacle only at the time of use.

At the desired time, the various components are mixed in the outer receptacle after the valve of the inner receptacle has been opened.

The opening of the valve is effected by pushing inwardly on the closing plug of the system, called a shutter, mounted in the bottom of the outer receptacle. Because it is necessary to push inwardly on the closing plug, there is a safeguard against inadvertent mixing. At the same time, there is a safeguard against incorrect manipulation of the dispensing valve, since no product can escape before the various components have been mixed since the propellent is initially contained in the inner receptacle.

Because the various components are mixed solely as a result of the action of pushing inwardly on the closing plug, and the product is dispensed solely as a result of action on the single dispensing valve, the present invention guarantees a high degree of operating safety. Furthermore, because only the inner receptacle contains propellent gas before final mixing, only the said inner receptacle is subjected to pressure from the said propellent gas, whereas the outer receptacle is not subjected to any pressure. Consequently, the safety of the double-chamber container system is greatly increased.

BRIEF DESCRIPTION OF THE DRAWING

The single FIGURE of the drawing is a vertical sectional view of a double-chamber container in accordance with the invention.

PREFERRED EMBODIMENT OF THE INVENTION

The double-chamber container with which this invention is concerned consists of a conventional commercial aerosol can 1, called an outer receptacle, which is equipped with a commonly used valve without a plunger tube, the said valve serving as a dispensing valve.

Fashioned in the bottom of the receptacle 1 is an orifice 3 into which an annular sealing gasket 4 made of plastic or elastomer is fitted. To ensure good retention of the gasket 4, it has a circular groove 5 at the level of the orifice 3 and a shoulder 6 which seats against the bottom of the outer receptacle 1 after the gasket 4 has been fitted in the orifice 3. The inner annular wall of the gasket 4 incorporates an annular collar 7. A closing plug 8 is inserted in the gasket 4. The closing plug 8 has two grooves 9 and 10, one above the other, in which the collar 7 fits in succession. Before the filling of the various components, the closing plug 8 is pushed into the gasket 4 in such a way that the collar 7 is positioned in the upper groove 9 and remains in this position until the time of use. At the time when the double-chamber container is used, the closing plug 8 is pushed inwardly through the sealing gasket 4 in the direction of the outer receptacle 1, until the collar 7 is positioned in the groove 10. In this position of the closing plug 8, the upper part 11 of the plug depresses the stem 12 of the male valve with which the inner receptacle 13 is equipped, the receptacle containing the propellent gas and one of the components of the product. The collar 7 is located in the part of the gasket 4 which is inside the outer receptacle 1, thus improving the sealing when the propellent gas has been discharged from the inner receptacle 13.

The action of depressing the stem 12 of the valve of the inner receptacle 13 causes the valve to open, thus allowing the content of the receptacle 13 to flow into the outer container 1 under the action of the propellent gas and thus ensure that the various components are mixed.

To make sure that the valve of the inner receptacle 13 opens under the effect of the pushing in of the closing plug 8, a strut 14 made of plastic or elastomer is attached to the lower part of the valve 2 of the outer receptacle 1, the dimensions of the strut being calculated in such a way that when the stem 12 of the valve of the inner receptacle 13 is depressed the bottom of the said inner receptacle comes up against the said strut 14 and is retained by it.

To ensure the positioning and centering of the inner receptacle 13, when the said receptacle 13 has been introduced upside down through the upper orifice of the outer receptacle 1 before the dispensing valve 2 has been mounted on the said outer receptacle 1, and to ensure that the stem 12 is centered on the contact surface 11 of the closing plug 8, an expandable and elastic ring 15 made of plastic, consisting, for example, of a hoop provided with corrugations in the radial direction and not forming an obstacle to the passage of the gas, is introduced into the outer container 1, the said ring 15 spreading after it has been introduced into the outer receptacle 1 and ensuring that the inner receptacle 13 is centered.

I claim:

1. A double-chamber aerosol container for the packaging of products with several components which are to come into contact and be mixed at the time of use; the said container comprising an outer aerosol receptacle having a dispensing valve at its upper end, said outer receptacle being adapted to contain one of the components of the product, an orifice in the bottom of the outer receptacle, an annular sealing gasket fitted in said orifice, said sealing gasket having an inwardly projecting annular collar, a closing plug fitted in said annular gasket, a pair of spaced apart annular groves in said closing plug, said closing plug being initially fitted in said annular gasket with said annular collar seated in one groove of said pair of annular grooves, an inner aerosol receptacle contained within said outer receptacle, said inner receptacle being smaller than said outer receptacle and having a stem valve at one end, said inner receptacle being adapted to contain a propellent gas and another component of the product, said inner receptacle being positioned upside down with respect to said outer container with its stem valve seated on the inner end of said closing plug, a strut in said outer receptacle positioned to prevent axial displacement of said inner receptacle, said closing plug being displaceable inwardly to a position wherein said annular collar seats in the other groove of said pair of annular grooves, whereby the stem valve of the inner receptacle is opened and the contents of the inner receptacle discharged into the outer container and admixed with its contents, and the sealed condition of the outer receptacle and positioning of the closing plug is ensured by the engagement of said annular collar with the other groove of said pair of annular grooves.

2. The double-chamber aerosol container claimed in claim 1 wherein said sealing gasket has a groove in its outer surface, said gasket being fitted in said orifice with said sealing gasket groove engaging the bottom of the outer container in the area immediately surrounding said orifice, said sealing gasket groove including an annular shoulder adapted to seat against the outer surface of the bottom of the outer receptacle to form a stop preventing inward displacement of said gasket.

3. The double-chamber aerosol container claimed in claim 1 wherein said strut is mounted on the inner end of the dispensing valve of the outer receptacle and is of a length to contact the bottom of the inner receptacle.

4. The double-chamber aerosol container claims in claim 1 including an expandable ring surrounding said inner receptacle and projecting outwardly therefrom for contact with said outer receptacle, whereby to position and center said inner receptacle within said outer receptacle.

* * * * *